United States Patent [19]

Myles et al.

[11] Patent Number: 5,017,047

[45] Date of Patent: May 21, 1991

[54] SOIL NAILING

[75] Inventors: Bernard Myles, Chepstow; Ronald J. Bridle, Gwent, both of United Kingdom

[73] Assignee: University College Cardiff Consultants Limited, Cardiff, United Kingdom

[21] Appl. No.: 346,539

[22] Filed: May 2, 1989

[51] Int. Cl.[5] ..... E21D 21/00; B25C 5/10

[52] U.S. Cl. ..... 405/259; 227/10; 227/130; 124/56

[58] Field of Search ..... 405/258, 259; 227/10, 227/15, 130; 114/295; 173/90, 129, 132; 254/29 R; 124/56

[56] References Cited

U.S. PATENT DOCUMENTS

| | | | |
|---|---|---|---|
| 2,512,831 | 6/1950 | Holmes | 405/239 X |
| 3,802,204 | 4/1974 | Mason . | |
| 3,819,101 | 6/1974 | Elders et al. | 405/259 X |
| 4,005,811 | 2/1977 | Garaty | 227/130 X |
| 4,033,419 | 7/1977 | Pennington | 405/259 X |
| 4,313,695 | 2/1982 | McCartney | 405/259 |

FOREIGN PATENT DOCUMENTS

| | | |
|---|---|---|
| 39654 | 11/1981 | European Pat. Off. . |
| 0278936 | 8/1988 | European Pat. Off. . |
| 2447424 | 8/1980 | France . |
| 7702212 | 2/1977 | Netherlands . |
| 627835 | 8/1949 | United Kingdom . |
| 1580142 | 11/1980 | United Kingdom . |
| 2058182 | 4/1981 | United Kingdom . |
| 2188958 | 10/1987 | United Kingdom . |

OTHER PUBLICATIONS

"Soil Nailing-Application & Practice-Part I", Ground Engineering, vol. 19(8) Nov. 86, and Part II, vol. 20(1) Jan. 87.

"Soil Nailing: The Second Decade"-International Conference on Foundations and Tunnels, London 1987.

"Soil Nailing", C. R. Coll. Int. Reinforcement des Sols Paril 1979.

Travaux, vol. 11, No. 553, Mar. 1981, pp. 76-81; G. Verrier et al.; "Confortement des remblais ferroviares une technique particulière: le clouage".

*Primary Examiner*—Dennis L. Taylor
*Assistant Examiner*—John A. Ricci
*Attorney, Agent, or Firm*—Beveridge, DeGrandi & Weilacher

[57] ABSTRACT

Soil nails are placed in the ground by driving a first elongate tubular member into the ground, driving a second member into the ground through a bore defined by the first member such that the second member is guided by the first member into a position in which it forms an extended soil nail, the second member being fired from a launcher with sufficient momentum to enter the bore and travel to its extending position. The second member may also be tubular to extend the bore so that further members can be driven to form a telescopic nail. The first member is fired from a launcher using a sabot which also serves to arrest penetration of the member.

23 Claims, 5 Drawing Sheets

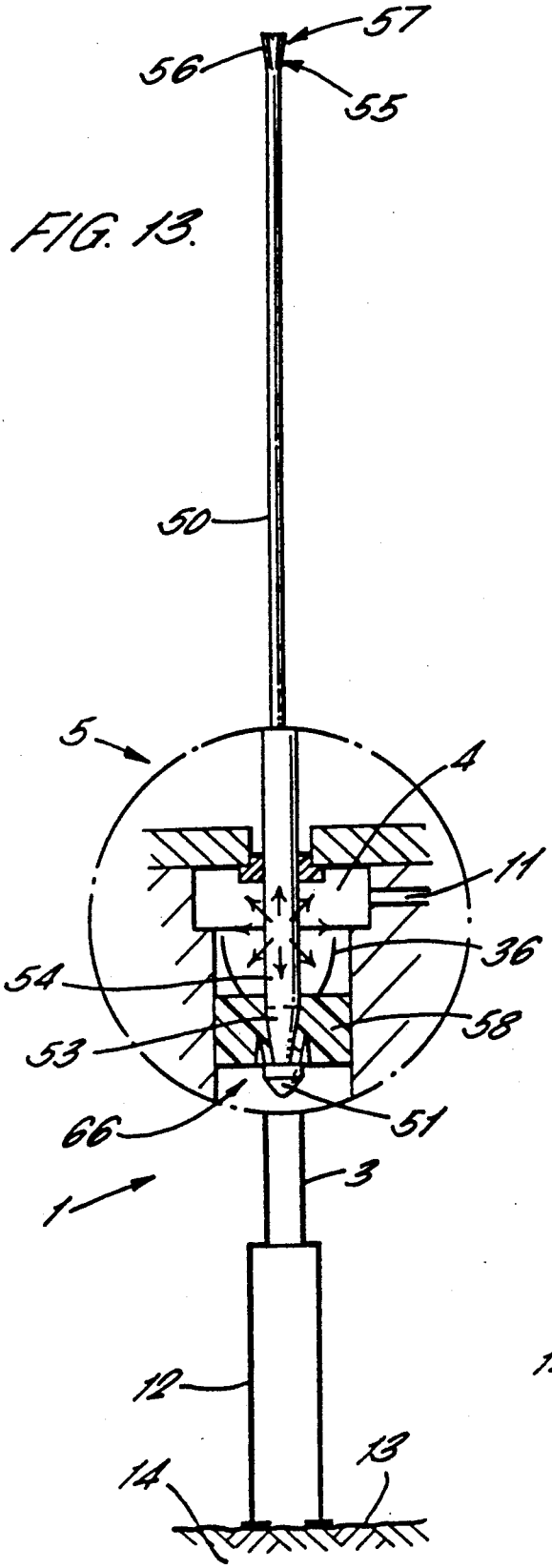
FIG. 13.
FIG. 14.
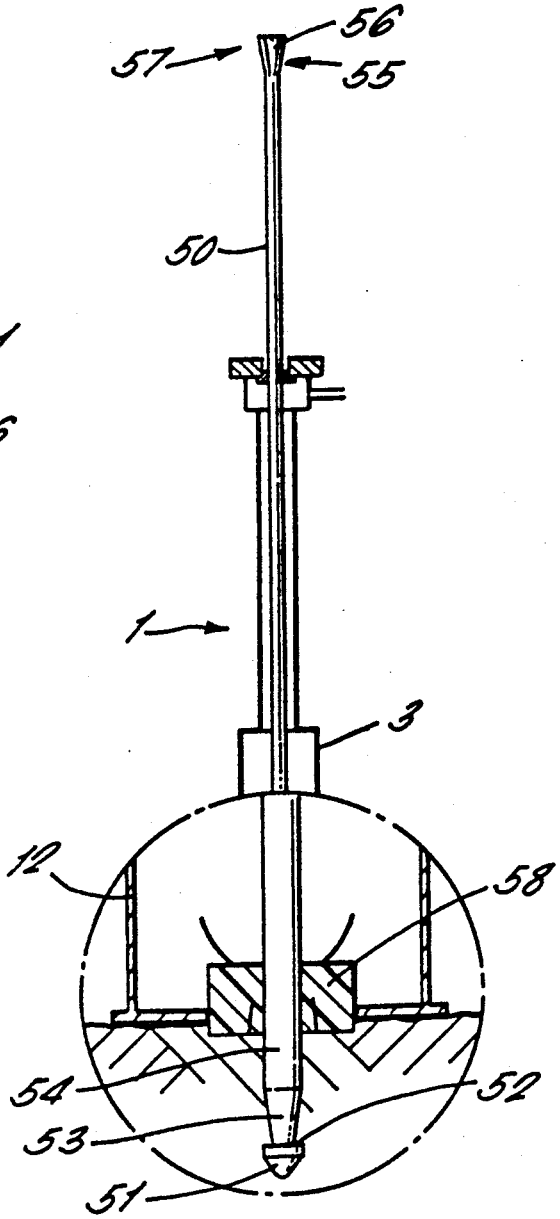

SOIL NAILING

This invention relates to soil nailing and in particular to a method and apparatus for placing a soil nail in the ground. It is known to provide ground strengthening by driving elongate reinforcing members known as soil nails into the ground in an array in order to improve the bulk properties of the ground.

GB-1580142 for example discloses the use of solid rods or tubes of 3 to 15 meters length arranged in a grid distributed over soil to be stabilized. EP-0239258 discloses the use of pickets fired from a launcher with sufficient momentum to penetrate and become embedded in the ground to provide a ground strengthening array.

Disadvantages of such methods are that where the penetration is required the length of soil nail may lead to handling difficulties particularly when the nails are to be fired from a launcher. A further problem when firing from a launcher is to control the depth of penetration. EP-0239258 discloses the use of pickets having enlarged heads which are fired through surface cladding so that the picket is arrested by impact with the head. There are many applications however where surface cladding is not required and in such cases the depth of penetration is difficult to control.

According to the present invention there is disclosed a method of soil nailing in which a soil nail is placed in the ground by driving a first elongate tubular member into the ground, driving a second elongate member into the ground through a bore defined by the first member such that the second member is guided by the first member into a position in which it forms an extension thereto and wherein the second member is fired from a launcher with sufficient momentum to enter the bore and travel to its extending position.

An advantage of such a method is that the penetration depth of the soil nail may thereby be extended in a convenient and efficient manner while avoiding the problem of handling excessive lengths of reinforcing members.

Preferably the first member is also driven into the ground by being fired from a launcher with sufficient momentum to enable the member to penetrate and become embedded in the ground. Members which are placed in the ground in this manner result in minimal disturbance to the surrounding soil compared with conventional methods of drilling or hammering soil nails into position.

The second member may be tubular thereby extending the bore and one or more further elongate members may be driven into the ground by being fired from a launcher through the extended bore to form one or more further extensions respectively.

The depth of penetration of the soil nail may thereby be extended in further stages to the desired depth.

Preferably the members comprising a soil nail may be coupled together by means of a grout or resin joint such that the assembled nail can withstand more readily both tensile and compressive loads.

Advantageously a reinforcing member may be located within the bore to provide additional strength.

Advantageously the members may be fired from a launcher having a tubular barrel through which the member is fired and which is positioned relative to the ground surface such that the travel of the member between the open end of the barrel and the ground surface is no more than one half the length of the member to thereby resist buckling and/or deflection of the member.

The barrel thereby serves as a tubular guide to resist bowing of the member which tends to occur on impact with the ground particularly where a glancing blow is made against a stone or other hard object. Since the bowing amplitude is a maximum at the mid-point of the member the guiding effect of the barrel is most effective if the mid-point is still within the barrel at the moment of impact with the ground surface. The barrel also serves to guide the member to resist deflection at an angle from the initial flight path. Guidance during the initial stages of penetration is particularly important since the subsequent trajectory of the member within the ground generally follows the initial trajectory established on penetration.

Preferably the member is a loose fit in the launcher barrel and is provided with a sabot which guides the member coaxially in the barrel during firing.

Members of different diameter may thereby fired using the same launcher barrel by providing a suitably dimensioned sabot.

Conveniently the member may be fired from the launcher by gas pressure acting on the sabot. The sabot may conveniently be initially located adjacent the forward end of the member and slidable to a position at the rearward end such that the sabot provides a radial enlargement of the member which arrests the travel of the first member after the member has penetrated the ground to a predetermined extent.

The second and any further members may similarly be provided with sabots but of a type which fragment on leaving the barrel and are discarded prior to entry of the member into the bore.

Conveniently the launcher includes a tubular baffle projecting coaxially from the barrel and having alignment means engageable with the sabot of the previously fired first member to thereby align the barrel axis with the bore prior to firing the second and/or further members.

According to a further aspect of the present invention there is disclosed apparatus for use in soil nailing comprising an elongate member, a launcher for firing the member into the ground, a barrel of the launcher coaxially receiving the member in a loaded position thereof, an annular sabot mounted on the member in sliding contact with the barrel, the member having a first stop means limiting movement of the sabot relative to the member towards a forward end of the member beyond a first position and second stop means limiting movement of the sabot relative to the member towards a rear end of the member beyond a second position whereby during firing of the launcher the sabot in its first position guides the member within the barrel and is movable upon engagement with the ground to its second position to constitute a radial enlargement of the member which limits the depth to which the member penetrates the ground.

An advantage of such apparatus is that the depth of penetration can be readily controlled and this is particularly important in the absence of any surface cladding.

Preferably the launcher has a breech defining a chamber communicating with the barrel, the member being locatable in a loaded position in the launcher so as to extend through the chamber in coaxial alignment with the barrel and projecting rearwardly of the chamber through an aperture defined by the breech, and wherein the launcher includes means admitting compressed gas to the chamber on firing whereby the pressurised gas acts on the sabot to drive the member through the barrel.

This has the advantage that members of varying length and diameter can be accommodated within a given launcher.

Preferably the apparatus includes an annular seal slidably mounted on the member and forming a seal between the member and the breech so as to close a rearward end of the chamber. The seal prevents the escape of gas from the chamber and seals of different size can be used to accommodate members of different diameter.

Preferably the sabot and the seal are connected by a frangible link which may for example be a plurality of resilient straps which are bowed such that the seal and the sabot are urged apart such that they are maintained in their respective position prior to firing of the launcher.

Preferably the second stop means comprises a radially projecting formation at the rear end of the member over which the seal cannot pass such that on being fired the seal engages the formation.

Conveniently the radially projecting formation comprises a plurality of circumferentially spaced ribs.

Conveniently the first stop means comprises an annular shoulder formed at the forward end of the member. The sabot may then include a segmented collar tapering in the forward direction with respect to the member into engagement with the shoulder.

The first stop means may alternatively comprise cooperating annular formations on the member and the sabot respectively, which formations are ramped to facilitate movement of the sabot relative to the member only in a direction towards the rearward end of the member.

Embodiments of the present invention will now be disclosed by way of example only and with reference to the accompanying drawings, of which:

Figures 1, 2, 3A, 3B, 4, 5, 7A, 7B:
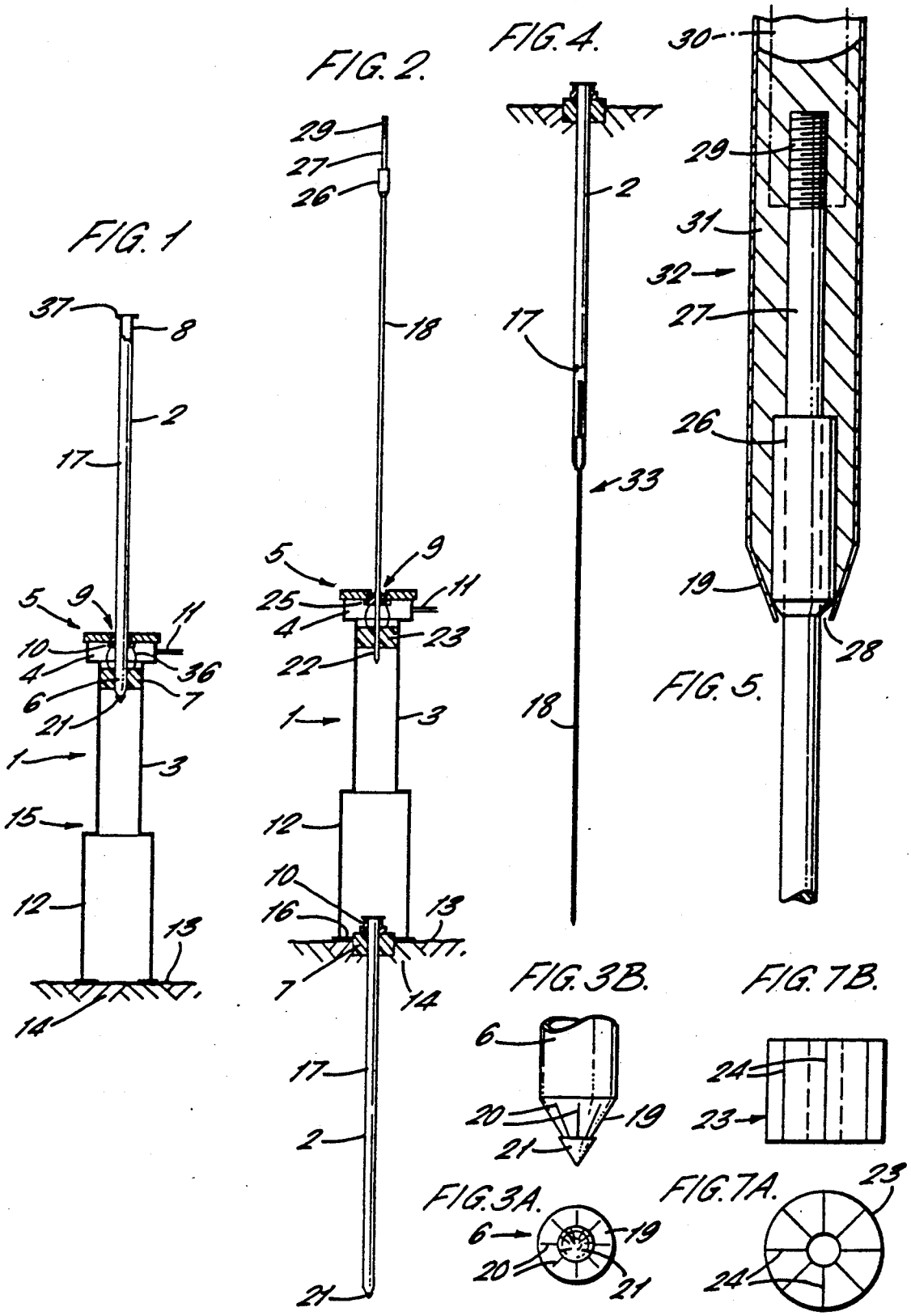
FIG. 1 is a partly sectioned elevation of a launcher loaded with a first tubular member ready for firing into the ground.
FIG. 2 shows the launcher of FIG. 1 after firing in which the first member is embedded in the ground and a second member is loaded in the launcher.

FIG. 3*a* is an end view of the tip of the first member of FIG. 1;

FIG. 3*b* is an elevation of the tip of FIG. 3*a;*

Figure 6:
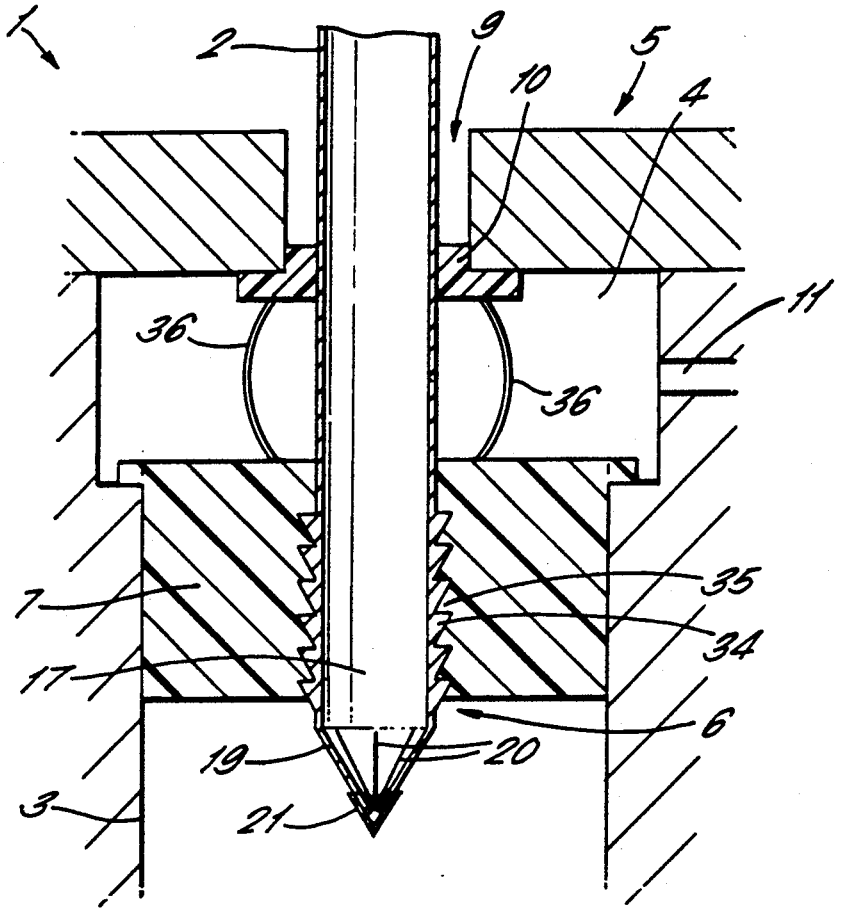

FIG. 4 is an elevation showing the first and second members of FIG. 2 after firing and jointing to form a soil nail;

FIG. 5 is a detailed partly sectioned view of the joint between the first and second members of FIG. 4;

FIG. 6 is an enlarged view of the firing chamber of the launcher of FIG. 1 showing the first tubular member connected to its sabot;

FIG. 7*a* is an end view of the sabot mounted on the second member of FIG. 2;

FIG. 7*b* is an elevation of the sabot of FIG. 7*a,*

Figure 8:
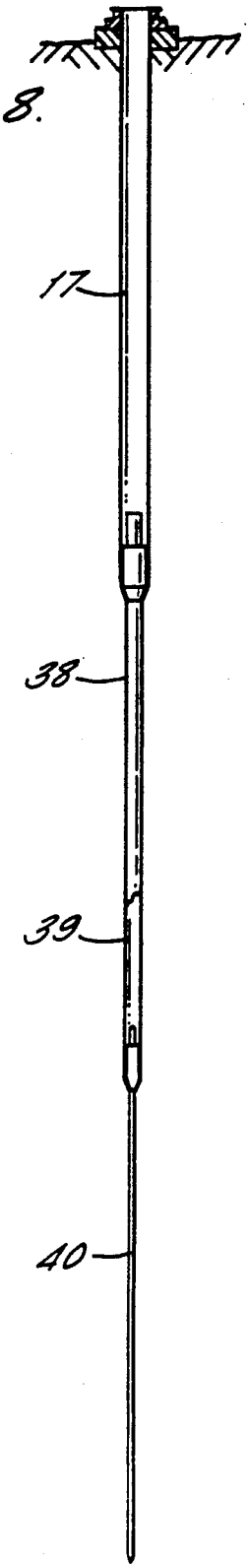
Figure 9:
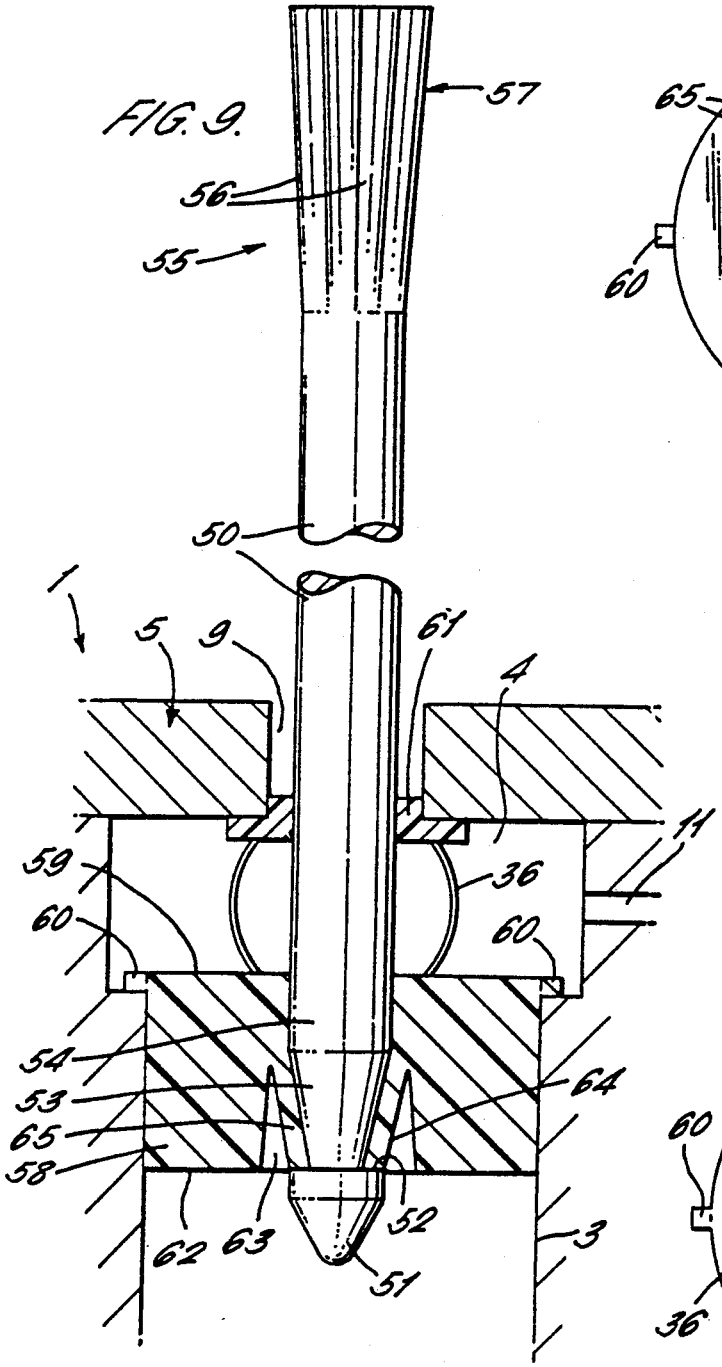
Figure 10:
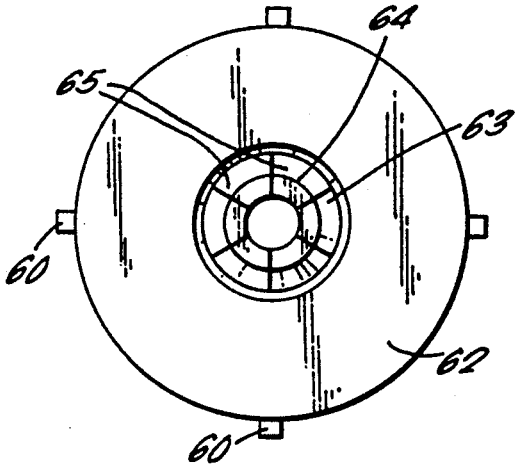
Figure 12:
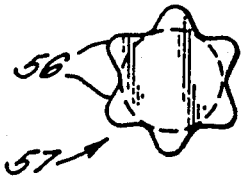
Figure 11:
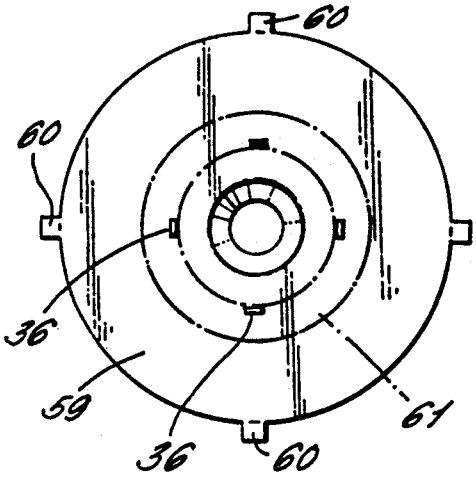
Figure 15:
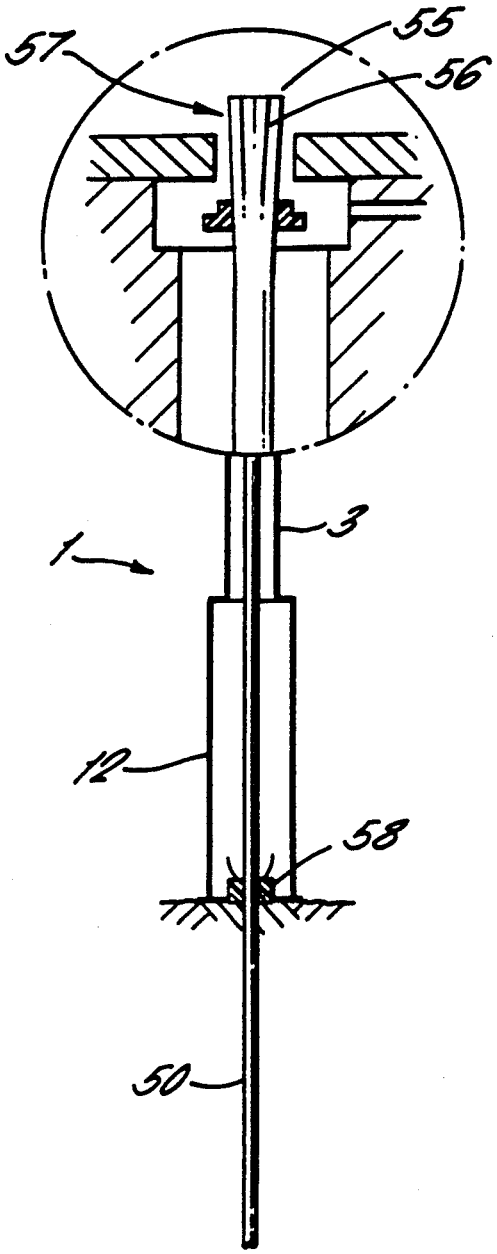
Figure 16:
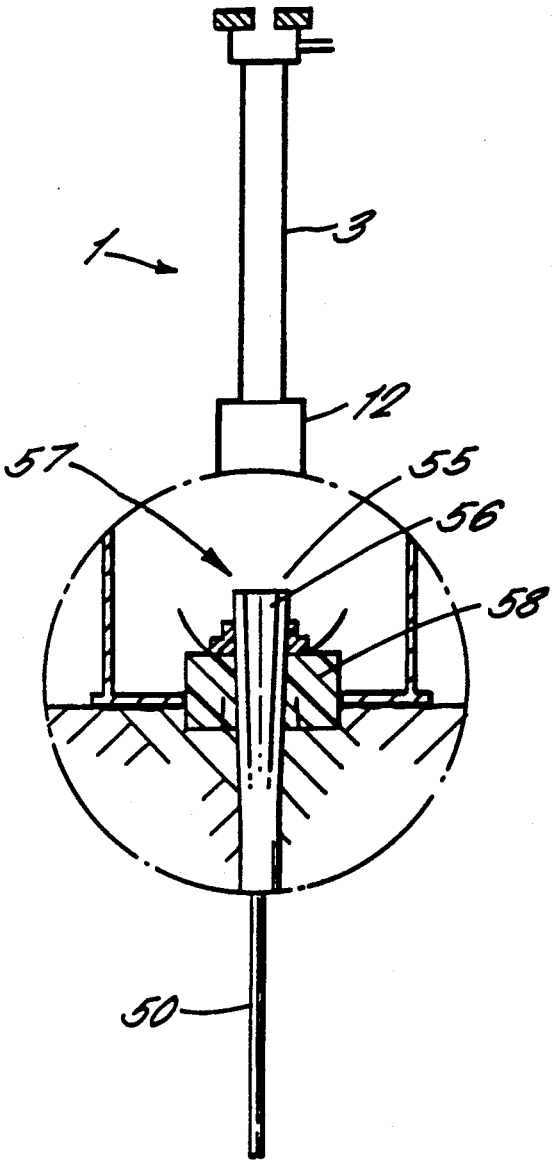

FIG. 8 is an elevation of a soil nail comprising first, second and third members;

FIG. 9 is a partly sectioned elevation of a solid member in its loaded position in a launcher;

FIG. 10 is a front end view of the sabot of FIG. 9;

FIG. 11 is a rear end view of the sabot of FIGS. 9 and 10;

FIG. 12 is a rear end view of the member of FIG. 9;

FIG. 13 is a partly sectioned elevation of the launcher and member of FIG. 9 shortly after firing;

FIG. 14 is a further view of the apparatus of FIG. 13 showing detail of the initial penetration of the ground by the member;

FIG. 15 is a similar view of the apparatus of FIGS. 9 to 14 showing detail of the breech seal being engaged by the rearward end of the member; and FIG. 16 is a similar view of the apparatus of FIGS. 9 to 15 showing detail of the sabot and seal after ground penetration.

In FIG. 1 a launcher 1 is shown in its loaded condition in which a first elongate tubular member 2 is located in the launcher ready for firing. The launcher 1 comprises a barrel 3 communicating with a chamber 4 defined by a breech 5.

A forward end 6 of the member 2 is received within an annular sabot 7 of a plastics material which is slidably received in the barrel 3 adjacent to the chamber 4.

The first member 2 extends through the chamber 4 and projects rearwardly of the launcher 1 through an aperture 9 formed in the breech 5 in axial alignment with the barrel 3. An annular breech seal 10 of a plastics material provides sealing between the member 2 and the breech 5 at the aperture 9.

The first member 2 is of 6 meters length of which 5 meters projects rearwardly of the launcher.

A gas inlet tube 11 is connected to the chamber 4 for the admission of compressed gas. A baffle 12 of larger diameter than the barrel 3 forms an axial projection of the barrel extending into contact with the surface 13 of a body of ground 14.

As shown in FIG. 1 the direction of travel of the first member 2 is vertically downwards and the travel between the lower end 15, of the barrel 3 and the ground surface 13 is 2 meters.

The sequence of events on firing the launcher will be described with reference to later Figures but results in the first member 2 being embedded in the ground 14 to an extent such that the sabot 7 is located at the surface 13 as shown in FIG. 2. The baffle 12 includes a locating ring 16 which is a snug fit around the sabot 7 such that the launcher 1 is then aligned with the previously fired first member 2. In this position a bore 17 defined by the first member 2 is coaxially in alignment with the barrel 3 and hence in alignment with a second member 18 loaded in the launcher as shown in FIG. 2.

The forward end 6 of the first member 2 has a tapered tip 19 as shown in FIGS. 3*a* and 3*b* in the form of a truncated cone which is segmented by means of axially extending slots 20. The slots 20 do not extend fully to the forward extremity of the tip 19 such that a thin retaining ring (not shown) maintains the shape of the cone during firing and gives sufficient strength to act as a stop which arrests the second member 18 as described below when fired through the bore 17. A detachable conical cap 21 overlays the tip 19 so as to close the forward end against the ingress of soil during ground penetration.

The second member 18 as shown in FIG. 2 in its loaded position has a forward end 22 which is carried in an annular sabot 23 of a plastics material which is received as a sliding fit within the barrel 3 and located adjacent to the chamber 4. The sabot 23 is different from the sabot 7 associated with the first member 2 in that the sabot 23 is segmented as shown in FIGS. 7*a* and 7*b* by radially extending cuts 24. For handling purposes prior to firing the segments are held together by means of adhesive tape (not shown).

The second member 18 is similarly provided with a breech seal 25 forming a seal in the aperture 9 of the breech 5 although the dimensions of the seal 25 are different to those of seal 10 since the diameter of the second member 18 is less than that of the first member 2 in order to facilitate penetration of the second member into the bore 17. The second member 18 has a collar 26 adjacent to but spaced from its rear end 27 which constitutes a radial enlargement dimensioned such that it will pass through the breech aperture 9 and will pass through the bore 17 but will not pass through the opening defined by the truncated tip 19 of the first member 2. The tip 19 thereby acts as a stop which arrests the second member 18 by engagement with the collar 26.

After firing the second member 18 into the bore 17 it comes to rest in the position shown in FIG. 4 in which it forms an extension to the first member 2 thereby projecting deeper into the ground 14 by almost the full length of the second member. As shown in detail in FIG. 5 the collar 26 is arrested by contact with the tapered tip 19 of the first member 2 since it is too large to pass through the opening 28 defined by the truncated tip. The rear end 27 of the second member 18 includes a threaded portion 29 engageable with a reinforcing member 30 shown in chain dot in FIG. 5 which optionally may be inserted within the bore 17 to provide additional strength.

The bore 17 is filled with grout or resin 31 adjacent to the tip 19 to form a joint 32 between the first and second members which is resistant to both tension and compression forces applied along the soil nail 33 constituted by the combined first and second members. For this purpose the collar 26 is deliberately spaced from the rear end 27 of the second member 18 in order to provide adequate bonding surfaces. The cap 21 is removed from the tip 19 on impact by the second member 18 during travel through the bore 17 and is therefore not shown in FIG. 4.

In FIG. 6 the sabot 7 associated with the first member 2 is shown to be connected to the forward end 6 by means of cooperating circumferential ribs 34 and grooves 35 formed on the first member 2 and the sabot 7 respectively. The ribs and grooves 34 and 35 are ramped to permit movement of the sabot 7 relative to the first member 2 only in a direction towards the rear end 8 of the member.

The sabot 7 and the breech seal 10 are connected by four circumferentially spaced thin straps 36 which are formed of a resilient plastics material and are bowed to exert a separating force between the breech seal 10 and the sabot 7. The breech seal and sabot are thereby held in position prior to firing. The straps also serve to maintain the breech seal 10 in position during handling of the first member 2. The straps 36 are formed so as to have a weak point adjacent to the junction between each strap with a breech seal 10.

The sequence of events in placing the soil nail of FIG. 4 in the ground is to first position the launcher 1 such that the baffle 12 is in contact with the ground surface 13 at the required location. A first member 2 is loaded in the launcher in the loaded position as shown in FIG. 1 and the launcher fired by admitting compressed gas to the chamber 4 via the gas inlet tube 11.

Gas pressure acting on the sabot 7 causes the member 2 to accelerate along the barrel 3 whilst the breech seal 10 is forced upwardly by gas pressure so as to remain held within the aperture 9 so that the straps 36 are broken. Continued downward motion of the tubular first member 2 is accompanied by further acceleration until the sabot emerges from the barrel into the baffle 12 at a speed of about 70 m.p.h. The member 2 continues its linear trajectory by virtue of its acquired momentum and travels into penetration with the ground surface 13. Any bowing of the member 2 or tendency to deflect the member by collision with hard objects in the ground 14 is limited by contact between the member 2 and the walls of the barrel 3. At the moment of initial ground penetration the mid-point of the member 2 is still contained within the barrel so that bowing is effectively controlled.

After initial penetration the member 2 continues along the trajectory established by initial penetration.

When the rear end 8 of the first member 2 encounters the breech seal 10 an enlargement 37 formed on the rear end of the member forces the seal 10 out of the aperture 9 such that the seal is carried with the member 2 on its trajectory. The sabot 7 is dissociated from its initial position at the forward end 6 of the first member 2 at the time of initial ground penetration because the diameter of the sabot 7 is much greater than that of the member 2 and hence has greater resistance to penetration of the ground. Consequently the sabot 7 comes to rest in a position as shown in FIG. 2 in which it is embedded partially into the ground 14. The seal 10 carried on the member 2 in contact with the enlargement 37 finally collides with the sabot 7 and this results in the member 2 being arrested. The member 2 thereby comes to rest at the position shown in FIG. 2 with the rear end 8 projecting slightly above the ground so that the bore 17 is accessible.

The launcher is then reloaded with the second member 18 together with its sabot 23 and breech seal 25 as shown in FIG. 2. The launcher is aligned by locating the locating ring 16 of the baffle 12 over the sabot 7. The launcher is then fired by admitting compressed gas to the chamber 4 resulting in gas pressure being applied to the sabot 23 and downward acceleration of the second member 18.

Downward motion of the second member 18 continues such that the sabot 23 enters the baffle 12 and fragments so as to fall away from the member. The second member 18 continues under its own momentum towards the first member 2 and enters the bore 17. The breech seal 25 is picked up by collision with the collar 26 and carried at the rear end 27 of the second member 18 into collision with the enlargement 37 at the mouth of the bore 17. The breech seal 25 shatters on impact and falls away from the second member 18 which continues to travel downwardly in the bore 17 until the collar 26 is arrested by contact with the tapered tip 19.

Grout or resin 31 is then inserted into the bore 17 to a depth sufficient to form a joint 32 as shown in FIGS. 4 and 5.

Optionally the steel reinforcing member 30 may then be inserted into the bore 17 and engaged with the threaded portion 29.

An extended soil nail 33 as shown in FIG. 4 is then provided. An array of such nails embedded in the soil will enhance the bulk properties of the ground. Typically the nails will be inserted in positions such that the nails intersect a slip plane at which the ground is expected to fall.

Although the ground surface has been shown as horizontal in the above Figures the method may similarly be used in strengthening ground having inclined surfaces or vertical surface where for example a wall of earth is to be reinforced. Where an inclined bank or wall is provided already with surface cladding then the nails may be fired through apertures formed in the surface cladding or may be fired directly through the cladding.

Alternatively the first member 2 may be placed in the soil without use of the launcher 1 using conventional drilling, hammering or vibration techniques. The second member 18 may then be fired using the launcher provided a suitably dimensioned location ring 16 is used.

In a further alternative method the second member 18 may be replaced by a further hollow member (not shown) of structure generally similar to that of the first member 2 referred to above but having a reduced outer diameter sufficient to be accommodated within the bore 17 of the first member 2.

Such a modified second member 38 as shown in FIG. 8 will form an extension to the bore 17 by providing an additional bore section 39 through which a further member 40 may be fired using the launcher 2. The further member 40 may be a solid rod or may again be modified to be tubular to thereby extend the bore and accommodate a further member fired from the launcher (not shown). The resulting soil nail may thereby comprise any number of members which are telescopically jointed in accordance with the above method.

A further aspect of the present invention is illustrated with reference to FIGS. 9 to 16 where corresponding reference numerals to those used in the preceding Figures are used where appropriate for corresponding elements.

In FIG. 9 an elongate member 50 is shown in its loaded position in a launcher 1. The member 50 may be of any required length but in this example is 6 meters in length and made of steel.

The member 50 has a conical tip 51 formed integrally with the member which is recessed immediately behind the tip to define the shoulder 52. A frusto-conical portion 53 of the member 50 extends between the shoulder 52 and an elongate cylindrical portion 54 which extends through the chamber 4 and projects rearwardly of the breech 5. A rear end 55 of the member is crimped to form a plurality of circumferentially spaced axially extending ribs 56 which progressively project radially to form a tapered enlargement 57 at the rear end 55.

The launcher 1 has a breech 5 defining a chamber 4 communicating with a barrel 3 and the breech is provided with an aperture 9 in axial alignment with the barrel 3 and through which the member 50 extends rearwardly of the breech.

A gas inlet tube 11 communicates with the chamber 4 for the admission of pressurised gas to the chamber.

The member 50 is a loose fit within the barrel 3 and carries a sabot 58 in the form of a collet fitting snugly on the forward end of the cylindrical portion 54 and dimensioned such that the sabot is a sliding fit within the barrel 3. The sabot 58 has a rear end 59 projecting into the chamber 4 and four radially extending lugs 60 project from the sabot into the chamber which is formed with a greater diameter than that of the barrel 3. The sabot 58 is thereby restrained prior to firing from movement along the barrel by the lugs 60.

An annular breech seal 61 is mounted coaxially on the cylindrical portion 54 of the member 50 and is of stepped diameter such that it projects partially into the aperture 9 formed in the breech 5. The breech seal 61 is dimensioned to be a sliding fit on the cylindrical portion 54 of the member 50. Four circumferentially spaced straps 36 connect the seal 61 with the sabot 58 and are dimensioned such that in the loaded position of the member 50 the straps are bowed and possess sufficient stiffness to exert a separating force between the seal and the sabot. The seal and sabot are thereby retained in their desired positions before firing.

The straps 36 are made sufficiently thin such that they are frangible on firing to permit separation of the sabot 58 and the seal 61 and are provided with a weak point adjacent to the point of connection with the seal so that on firing the straps remain attached to the sabot as shown in FIG. 13.

The sabot 58 is generally cylindrical having a forward face 62 having a central recess 63. An annular segmented truncated cone portion 64 projects forwardly within the recess 63 into contact with the shoulder 52 to thereby resist movement of the sabot relative to the member 50 in a direction towards its forward end. The cone portion 64 is segmented by slots 65 formed radially and extending longitudinally of the member. The relative dimensions of the recess 63 and the cone portion 64 are such that the cylindrical portion 54 can be accommodated within the cone portion by radially outward deflection of the segmented portion such that the segments 65 are accommodated within the recess 63. The member 50 can thereby be driven through the sabot by downward movement of the member if the sabot 58 is held stationary but movement in the upward direction is prevented by abutment between the shoulder 52 and the cone portion 64.

By this arrangement the cone portion 64 and cooperating features of the member 50 constitute stop means permitting relative movement in one direction only.

The launcher 1 includes a baffle 12 which forms an extension to the barrel 3 of enlarged diameter as shown in FIG. 13. To fire the launcher 1 the baffle 12 is placed in contact with the surface 13 of a body of ground 14 at the required location and the launcher is fired by admitting compressed gas to the chamber 4 through the gas inlet tube 11. The gas pressure contained within the chamber 4 exerts on the sabot 58 a downward force resulting in acceleration of the sabot and with it the member 50 which is constrained to move with the sabot by the stop means 66. FIG. 13 shows the position of the sabot 58 shortly after it begins to move downwardly within the barrel. Gas pressure within the chamber 4 presses the breech seal 61 into sealing engagement with the breech 5 and the relative movement between the sabot 58 and the seal results in breakage of the straps 36 which continue to be attached to the sabot.

Downward motion of the member 50 in line with the barrel 3 continues until the sabot 58 passes out of the barrel 3 into the baffle 12 during which travel the member continues to be accelerated. Thereafter the member 50 continues its trajectory under its acquired momentum and penetrates the ground as shown in FIG. 14. Gas escaping from the barrel 3 into the baffle 12 is then able to expand freely so that the barrel serves as a silencer. Because the sabot 58 is of larger diameter than the member 50 it has a greater resistance to ground penetration and will penetrate only slightly the ground surface 13 as shown in FIG. 14. Relative movement of the sabot towards the rear end 58 of the member 50 is accommodated by the stop means 66 since the conical portion 53 of the member forces apart the segments 65 of the cone portion 64 and permits the cylindrical portion 54 to be passed through the sabot.

Continued travel of the member 50 results in the enlargement 57 at the rear end 55 of the member engaging the breech seal 61 which is carried with it as shown in FIG. 15 through the chamber 4 and into the barrel 3.

Continued travel of the member 50 into the ground results in impact between the seal 61 and the sabot 58. The seal 61 is formed of a material sufficiently strong to withstand the resultant radial pressure exerted by the enlargement 57 so that the member 50 is arrested. Some further penetration into the ground of the sabot 58 at this instant will occur but generally this travel will be less than the thickness of the sabot.

The seal 61 and the enlargement 57 together constitute a second stop means preventing movement of the sabot relative to the member 50 in a direction towards the rear end 55 beyond the position shown in FIG. 16 where the sabot is adjacent to but spaced from the rear end.

The penetration of the soil nail placed by firing from the launcher may thereby be accurately controlled. The member 50 in the example shown in FIGS. 9 to 16 is a solid steel rod but may alternatively be tubular with the conical tip 51 being formed as a separate element connected by welding or otherwise to the cylindrical portion of the member.

The first stop means may alternatively comprise cooperating ribs and grooves 34 and 35 as shown in FIG. 6 which are ramped to permit movement of the sabot relative to the member only in a direction towards the rear end.

The use of a sabot permits members of different diameter to be accommodated within a launcher of a given barrel size simply by changing the dimensions of the sabot and breech seal.

The arrangement of a launcher in which the bulk of the member projects rearwardly of the breech allows the launcher of a given barrel length to be used with members of greatly varying length.

A further advantage of the above apparatus is that the gas pressure admitted to the chamber need not be closely controlled in order to match a required penetration depth since it is sufficient to provide a level of gas pressure which will ensure penetration for all applications and rely on the sabot to arrest the member at the required depth of penetration.

We claim:

1. A method of soil nailing in which a soil nail is placed in the ground by driving a first elongate tubular member into the ground and driving a second elongate member into the ground through a bore defined by the first member such that the second member is guided by the first member into an extended position in which it forms an extension to the first member, said method including the steps of loading the second member into a barrel of a launcher in a position where the second member is external to a mouth of the bore and axially aligned with the bore, providing the second member with a sabot which is a sliding fit in the barrel, supporting the barrel such that a forward end of the barrel is spaced from the mouth of the bore, admitting pressurized gas to the barrel to apply an accelerating force to the sabot so as to drive the sabot and with it the second member towards the forward end of the barrel, allowing the second member to travel towards the mouth of the bore such that the sabot exits the barrel thereby discontinuing the accelerating force, allowing the second member to thereafter travel towards and into the bore and thereafter continue to travel under its own momentum through the bore and arresting the second member after it has travelled to the extended position, which method includes the step of providing the sabot with fragmenting means whereby the sabot fragments on leaving the barrel and is discarded prior to entry of the second member into the bore providing a radial enlargement of the second member and a constriction of the first member which are co-operable to arrest the second member at the extended position.

2. A method as claimed in claim 1 wherein the first member is driven into the ground by being fired from said launcher with sufficient momentum to enable the member, after being fired from the launcher, to penetrate and become embedded in the ground.

3. A method as claimed in claim 1 wherein the second member is tubular thereby extending the bore and one or more further elongate members are driven into the ground by being fired from said launcher through the bore to form one or more further extensions respectively.

4. A method as claimed in claim 1 including the step of coupling the members together by means of a grout or resin joint.

5. A method as claimed in claim 1 including the step of locating a reinforcing member within the bore.

6. A method as claimed in claim 1 including the step of firing at least one of the first and second members from the launcher while supporting the barrel so as to be positioned relative to the ground surface such that the travel of the member between the open end of the barrel and the ground surface is no more than one half the length of the member to thereby resist buckling and/or deflection of the member.

7. A method as claimed in claim 6 wherein the first member is fired from the launcher by gas pressure acting on the sabot.

8. A method as claimed in claim 7 wherein the sabot arrests the travel of the first member after the first member has penetrated the ground to a predetermined extent.

9. A method as claimed in claim 8 wherein the launcher includes a tubular baffle projecting coaxially from the barrel and having alignment means engageable with the sabot of the previously fired first member to thereby align the barrel axis with the bore prior to firing the second and/or further members.

10. A method as claimed in claim 1 including the step of providing a plurality of radially extending cuts in the sabot thereby constituting the fragmenting means.

11. Apparatus for use in soil nailing comprising an elongate member, a launcher for firing the member into the ground, a barrel of the launcher coaxially receiving the member in a loaded position thereof, an annular sabot mounted on the member in sliding contact with the barrel, the member having a first stop means limiting movement of the sabot relative to the member towards a forward end of the member beyond a first position and second stop means limiting movement of the sabot relative to the member towards a rear end of the member beyond a second position whereby during firing of the launcher the sabot in its first position guides the member within the barrel and is movable upon engagement with the ground to its second position to constitute a radial enlargement of the member which limits the depth to which the member penetrates the ground.

12. Apparatus as claimed in claim 11 wherein the launcher has a breech defining a chamber communicating with the barrel, the member being locatable in a loaded position in the launcher so as to extend through the chamber in coaxial alignment with the barrel and projecting rearwardly of the chamber through an aperture defined by the breech, and wherein the launcher includes means admitting compressed gas to the chamber on firing whereby the pressurised gas acts on the sabot to drive the member through the barrel.

13. Apparatus as claimed in claim 12 including an annular seal slidably mounted on the member and forming a seal between the member and the breech so as to close a rearward end of the chamber.

14. Apparatus as claimed in claim 13 wherein the sabot and the seal are connected by a frangible link which exerts a separating force between the seal and the sabot.

15. Apparatus as claimed in claim 13 wherein the second stop means comprises a radially projecting formation at the rear end of the member over which the seal cannot pass such that on being fired the seal engages the formation.

16. Apparatus as claimed in claim 15 wherein the radially projecting formation comprises a plurality of circumferentially spaced ribs.

17. Apparatus as claimed in claim 11 wherein the first stop means comprises an annular shoulder formed at the forward end of the member.

18. Apparatus as claimed in claim 17 wherein the sabot includes a segmented collar tapering in the forward direction with respect to the member into engagement with the shoulder.

19. Apparatus as claimed in claim 11 wherein the first stop means comprises cooperating annular formations on the member and the sabot respectively, which formations are ramped to facilitate movement of the sabot relative to the member only in a direction towards the rearward end of the member.

20. Apparatus as claimed in claim 19 wherein the member is tubular, the forward end of the member having a tip portion of segmented truncated conical shape, and further including a cap overlaying the tip.

21. Apparatus as claimed in claim 11 wherein the launcher includes a baffle projecting forwardly of the barrel and contacting in use the surface of the ground, the length of the baffle being no more than one half the length of the member such that the barrel constitutes a guide resisting buckling and/or deflection of the member during firing.

22. A method of soil nailing in which a soil nail is placed in the ground including the steps of loading a first elongate tubular member into a barrel of a launcher such that the first member is a loose fit in the barrel, providing the first member with a first sabot which is a sliding fit in the barrel and which guides the first member coaxially in the barrel during firing, admitting pressurized gas to the barrel thereby firing the first member from the launcher by gas pressure acting on the sabot, allowing the first member to thereafter penetrate and become embedded in the ground under its own momentum, arresting the first member after it has penetrated the ground to a predetermined extent by means of the first sabot, loading a second elongate member into the barrel such that the second member is a loose fit in the barrel, providing the second member with a second sabot which is a sliding fit in the barrel and which guides the second member coaxially in the barrel during firing, admitting pressurized gas to the barrel thereby firing the second member from the launcher by gas pressure acting on the sabot, and allowing the second member under its own momentum to thereafter enter and travel through a bore defined by the first member whereby the second member is driven into the ground while guided by the first member into a position in which it forms an extension thereto.

23. A method as claimed in claim 22 including the step of providing the launcher with a tubular baffle projecting coaxially from the barrel and having alignment means engagable with the first sabot of the previously fired first member to thereby coaxially align the barrel with the bore prior to firing the second and/or further member.

* * * * *